US009920725B2

(12) United States Patent
Fukutomi et al.

(10) Patent No.: US 9,920,725 B2
(45) Date of Patent: Mar. 20, 2018

(54) FUEL INJECTION VALVE

(71) Applicant: Mitsubishi Electric Corporation, Tokyo (JP)

(72) Inventors: Norihisa Fukutomi, Tokyo (JP); Akio Shingu, Tokyo (JP); Kyosuke Watanabe, Tokyo (JP); Tsuyoshi Munezane, Tokyo (JP); Manabu Hirai, Hyogo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 15/300,364

(22) PCT Filed: May 16, 2014

(86) PCT No.: PCT/JP2014/063072

§ 371 (c)(1),
(2) Date: Sep. 29, 2016

(87) PCT Pub. No.: WO2015/173950

PCT Pub. Date: Nov. 19, 2015

(65) Prior Publication Data

US 2017/0145971 A1 May 25, 2017

(51) Int. Cl.

| | |
|---|---|
| ***F02M 51/06*** | (2006.01) |
| ***F02M 61/14*** | (2006.01) |
| ***F02M 51/00*** | (2006.01) |

(52) U.S. Cl.

CPC ..... *F02M 51/061* (2013.01); *F02M 51/005* (2013.01); *F02M 61/14* (2013.01)

(58) Field of Classification Search

CPC ..... F02M 51/061; F02M 51/005; F02M 61/14

(Continued)

(56) References Cited

U.S. PATENT DOCUMENTS 5,201,341 A * 4/1993 Saito ..... F02D 7/02 123/557
2002/0130206 A1* 9/2002 Kobayashi ..... F02M 51/005 239/585.4

(Continued)

FOREIGN PATENT DOCUMENTS

JP 2006-90266 A 4/2006
JP 2006-090268 A 4/2006

(Continued)

OTHER PUBLICATIONS

International Search Report of PCT/JP2014/063072 dated Jul. 8, 2014 [PCT/ISA/210].

(Continued)

*Primary Examiner* — Mahmoud Gimie
(74) *Attorney, Agent, or Firm* — Sughrue Mion, PLLC; Richard C. Turner

(57) ABSTRACT

In a fuel injection valve, a bobbin includes a bobbin main body serving as a part around which a coil is wound, and a terminal housing portion projecting upward from a part of a circumferential direction of the bobbin main body. The terminal housing portion is exposed to the exterior of a cap. A terminal is inserted into the terminal housing portion and electrically connected to the coil. A gap is provided between the core and a housing portion inner surface serving as a core side surface of the terminal housing portion. Resin used to form the connector mold penetrates the gap.

11 Claims, 6 Drawing Sheets

(58) Field of Classification Search
USPC ..... 123/470, 490; 239/585.1; 251/129.21, 251/129.15
See application file for complete search history.

(56) References Cited

U.S. PATENT DOCUMENTS

| | | | | |
|---|---|---|---|---|
| 2006/0214032 | A1* | 9/2006 | Akabane ..... | F02M 51/0682 239/585.1 |
| 2009/0007886 | A1 | 1/2009 | Akabane et al. | |

FOREIGN PATENT DOCUMENTS

| | | | |
|---|---|---|---|
| JP | 2007-009764 | A | 1/2007 |
| JP | 2010-203237 | A | 9/2010 |

OTHER PUBLICATIONS

Communication dated Jul. 11, 2017 from the Japanese Patent Office in counterpart Application No. 2016-519070.

* cited by examiner

FUEL INJECTION VALVE

CROSS REFERENCE TO RELATED APPLICATIONS

This application is a National Stage of International Application No. PCT/JP2014/063072, filed May 16, 2014, the contents of which are incorporated herein by reference in its entirety.

TECHNICAL FIELD

This invention relates to a solenoid type fuel injection valve used in a fuel supply system for supplying fuel to an internal combustion engine or the like, for example.

BACKGROUND ART

In a conventional fuel injection valve, a movable valve body that constitutes a valve mechanism is constituted by an armature and a valve portion. Further, a solenoid device is constituted by a resin bobbin, a coil wound around the bobbin, a metal core, a housing, and a lid-shaped cap. Terminals serving as electrodes are connected to the coil.

A pipe is disposed between the housing and the armature. A valve seat, the movable valve body, a spring that pushes the movable valve body toward the valve seat side, the armature, and the core are inserted into the pipe. The bobbin is mounted on an outer periphery of the pipe and housed in the housing. The cap is welded to one axial direction end portion of the housing so as to cover the bobbin.

The terminals, the pipe, the housing, and the cap are insert-molded in a connector mold. An upper end portion of the pipe projects to the outside of the connector mold. Further, a rubber ring (an O ring) is mounted on an outer periphery of the upper end portion of the pipe.

An inner peripheral surface of the bobbin contacts an outer peripheral surface of the pipe entirely, with no gaps. As a result, the bobbin is mounted on the pipe without play.

When the valve is closed, the valve body is pressed against the valve seat by the spring. When the terminals are energized from this condition, the solenoid device is excited such that the armature is attracted to the core side. Accordingly, the movable valve body moves to the core side such that a gap is formed between the valve portion and the valve seat (i.e. such that the valve opens), and as a result, fuel flows through the gap (see PTL 1, for example).

CITATION LIST

Patent Literature

[PTL 1]
Japanese Patent Application Publication No. 2007-9764

SUMMARY OF INVENTION

Technical Problem

In a conventional fuel injection valve such as that described above, when moisture infiltrates the fuel injection valve through a boundary portion between the pipe and the connector mold from a lower portion of the rubber ring, for example, and advances to the bobbin, the moisture moves over an upper surface of the bobbin because the bobbin is mounted on the outer periphery of the pipe without gaps. When the moisture reaches parts of the terminals that are drawn into the bobbin, the pipe and the terminals become electrically conductive, and as a result, a leak current is generated, leading to instability in an injection amount characteristic.

Particularly in recent years, internal combustion engines employing fuel injection (FI) are being introduced with increasing regularity in motorcycles that generate small amounts of exhaust gas, and therefore a fuel injection valve having a reduced attachment length and a small outer diameter may be applied to a motorcycle. When water is splashed up by the motorcycle, the fuel injection valve may become wet, and it is therefore necessary to prevent instability in the injection amount characteristic caused by moisture, as described above.

This invention has been designed to solve the problem described above, and an object thereof is to obtain a fuel injection valve with which moisture can be prevented from contacting terminals provided in a connector mold so that a stable injection amount characteristic can be realized.

Solution to Problem

A fuel injection valve according to this invention includes a holder, a valve seat fixed to the holder, a valve body provided to be capable of sliding in the holder, a spring that pushes the valve body toward the valve seat side, a solenoid device that includes a metal core fixed to the holder, a resin bobbin mounted on an outer periphery of the core, a coil wound around the bobbin, a metal housing surrounding the bobbin, and a metal cap provided on an end portion of the housing so as to cover the bobbin, and that generates an electromagnetic force for pulling the valve body away from the valve seat against the spring, a connector mold that includes a connector portion and is molded integrally with the holder and the solenoid device, and a terminal that is drawn out from the connector portion and electrically connected to the coil, wherein the bobbin includes a bobbin main body serving as a part around which the coil is wound, and a terminal housing portion projecting upward from a part of a circumferential direction of the bobbin main body, the terminal housing portion is exposed to the exterior of the cap, the terminal is inserted into the terminal housing portion and electrically connected to the coil, a gap is provided between the core and a housing portion inner surface serving as a core side surface of the terminal housing portion, and resin used to form the connector mold penetrates the gap.

Advantageous Effects of Invention

In the fuel injection valve according to this invention, the gap is provided between the core and the housing portion inner surface serving as the core side surface of the terminal housing portion, and the resin used to form the connector mold penetrates the gap. Hence, moisture infiltrates the fuel injection valve between the core and the connector mold is prevented from advancing to the housing portion upper surface, and accordingly, the moisture is prevented from contacting the terminal provided in the connector mold. As a result, a stable injection amount characteristic can be realized.

DESCRIPTION OF EMBODIMENTS

Embodiments of this invention will be described below with reference to the drawings.

First Embodiment

Figure 1:
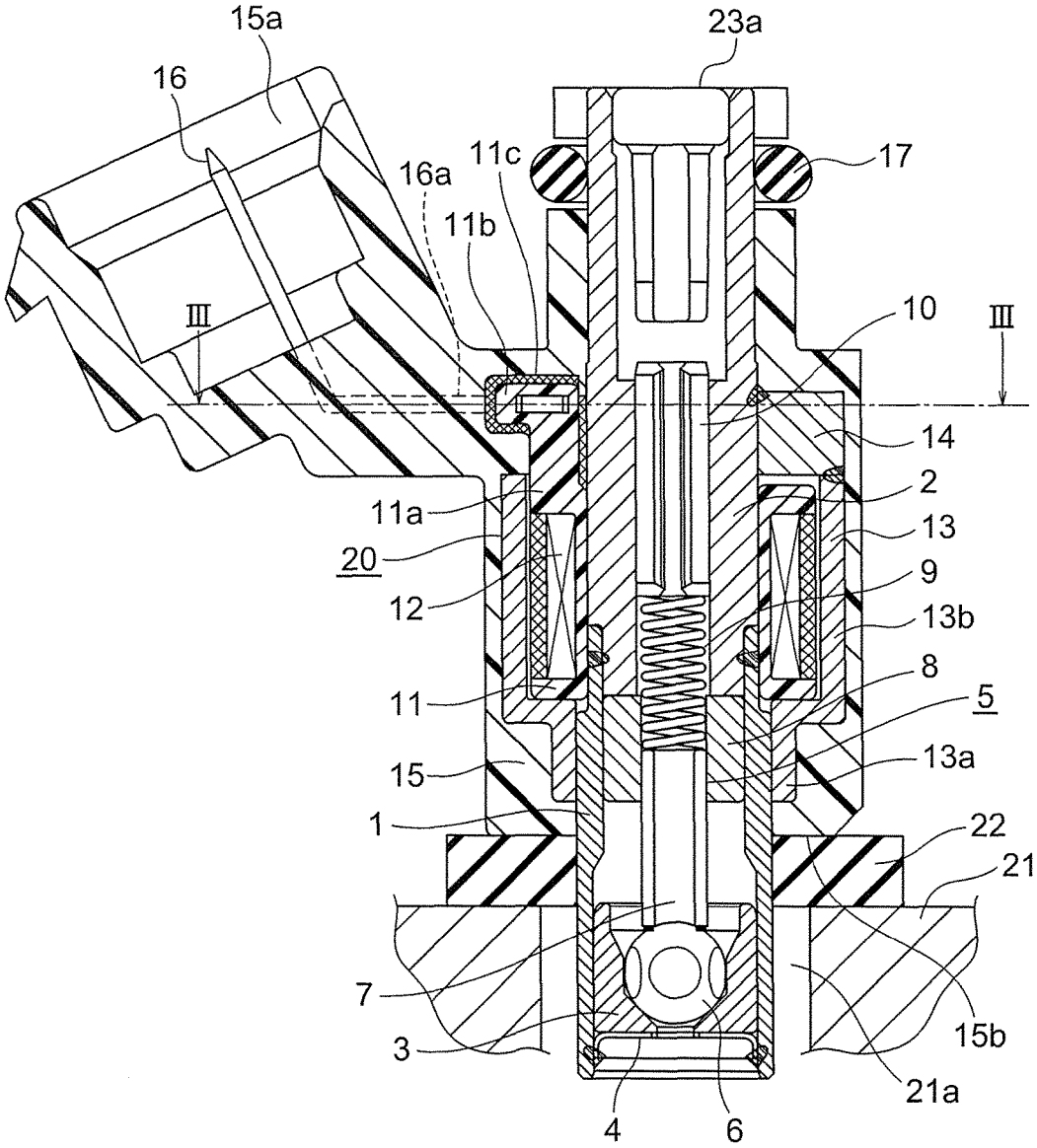
FIG. 1 is a sectional view taken along an axis line of a fuel injection valve according to a first embodiment of this invention.

FIG. 1 is a sectional view taken along an axis line of a fuel injection valve according to a first embodiment of this invention. Fuel flows downward from an upper end of the fuel injection valve shown in FIG. 1. In the drawing, a cylindrical metal core (a fixed core) 2 is fixed to an upper end portion of a cylindrical holder 1. The holder 1 and the core 2 are disposed coaxially. Further, the holder 1 is press-fitted into and welded to a downstream side end portion of the core 2.

A valve seat 3 and an injection hole plate 4 are fixed to an inside lower end portion of the holder 1. A plurality of injection holes through which fuel is injected are provided in the injection hole plate 4. The injection holes penetrate the injection hole plate 4 in a plate thickness direction (a vertical direction in FIG. 1). Further, the injection hole plate 4 is welded to a downstream side end surface of the valve seat 3, inserted into the holder 1 in this condition, and then welded to the holder 1.

A valve body 5 is inserted into the holder 1. The valve body 5 includes a valve portion (a ball) 6, a needle pipe 7 welded to the valve portion 6, and an armature (a movable core) 8 fixed to an upstream side end portion of the needle pipe 7 (an opposite side end portion to the valve portion 6).

The armature 8 is capable of sliding in the holder 1 in an axial direction. When the armature 8 slides, the needle pipe 7 and the valve portion 6 move integrally in the axial direction. As a result, the valve portion 6 is seated on or separated from the valve seat 3. Further, an upper end surface of the armature 8 comes into contact with or separates from a lower end surface of the core 2.

A spring 9 that pushes the needle pipe 7 in a direction for pressing the valve portion 6 against the valve seat 3 is inserted into the core 2. Further, a rod (an adjuster) 10 that adjusts a load exerted by the spring 9 is inserted into the core 2.

A resin bobbin 11 is mounted on an outer periphery of a part of the holder 1 that is fixed to the core 2 and the downstream side end portion (the armature 8 side end portion) of the core 2. A coil 12 is wound around an outer periphery of the bobbin 11.

An upstream side end portion of the holder 1, apart of the bobbin 11 on which the coil 12 is mounted, and the coil 12 are housed in a metal housing 13. The housing 13 includes a lower cylindrical portion 13*a* that contacts an outer peripheral surface of the holder 1, and an upper cylindrical portion 13*b* that surrounds the bobbin 11. A diameter of the upper cylindrical portion 13*b* is larger than a diameter of the lower cylindrical portion 13*a*. In other words, the housing 13 has a two-stage cylindrical shape.

A lid-shaped cap 14 that covers the bobbin 11 is fixed to an end portion of the upper cylindrical portion 13*b* on an opposite side to the lower cylindrical portion 13*a*. The cap 14 is made of metal and welded to apart of an outer periphery of the housing 13.

A connector mold 15 is molded integrally with the respective outer peripheries of the holder 1, the core 2, the bobbin 11, the housing 13, and the cap 14. The connector mold 15 includes a connector portion 15*a*. A pair of terminals 16 are drawn out from the connector portion 15*a* and electrically connected to the coil 12.

An upper end portion of the core 2 projects from the connector mold 15 so as to serve as a fuel introduction portion. Further, a rubber ring (an O ring) 17 is mounted on an outer periphery of the upper end portion of the core 2.

A solenoid device 20 includes the core 2, the bobbin 11, the coil 12, the housing 13, and the cap 14. Further, the solenoid device 20 generates an electromagnetic force for pulling the valve body 5 away from the valve seat 3 against the spring 9.

The fuel injection valve is fixed to a valve mounting portion 21 of an internal combustion engine. A tip end portion (a lower end portion) of the holder 1 is inserted into an intake passage 21*a* provided in the valve mounting portion 21. A sealing member 22 is interposed between the valve mounting portion 21 and a joint end surface 15*b* of the connector mold 15, the joint end surface 15*b* being a surface by which the connector mold 15 is joined to the valve mounting portion 21.

When the valve is closed, the valve portion 6 is pressed against the valve seat 3 by the spring 9. When the terminals 16 are energized from this condition, the solenoid device 20 is excited such that the armature 8 is attracted toward the core 2 side. Accordingly, the valve body 5 moves toward the core 2 side such that a gap is formed between the valve portion 6 and the valve seat 3 (i.e. such that the valve opens), and as a result, fuel is injected into the intake passage 21*a* through the injection holes in the injection hole plate 4.

When energization of the coil 12 is stopped, magnetic flux generated by the solenoid device decreases such that the valve body 5 is moved downward in FIG. 1 by a spring force of the spring 9. As a result, the gap between the valve portion 6 and the valve seat 3 closes, whereby fuel injection is terminated.

An attachment length (a substantial length by which the fuel injection valve projects outwardly from the valve mounting portion 21) from an upper end surface 23*a* of the fuel injection valve to the joint end surface 15*b* (the joint surface by which the connector mold 15 is joined to the sealing member 22) is shortened by minimizing an axial direction dimension of the bobbin 11. For this purpose, coil connection portions 16*a* serving as connection portions by which the terminals 16 are respectively connected to the coil 12 are deployed in a horizontal direction.

The bobbin 11 includes a bobbin main body 11*a* serving as a part around which the coil 12 is wound, and a terminal housing portion 11*b* that projects upward from a part of a circumferential direction of the bobbin main body 11*a*. The terminal housing portion 11*b* is exposed to the exterior of the cap 14 through a cutout portion provided in the cap 14. By deploying the coil connection portions 16*a* in the horizontal direction, a horizontal or substantially horizontal housing portion upper surface 11*c* is formed on the terminal housing portion 11*b*.

Figure 2:
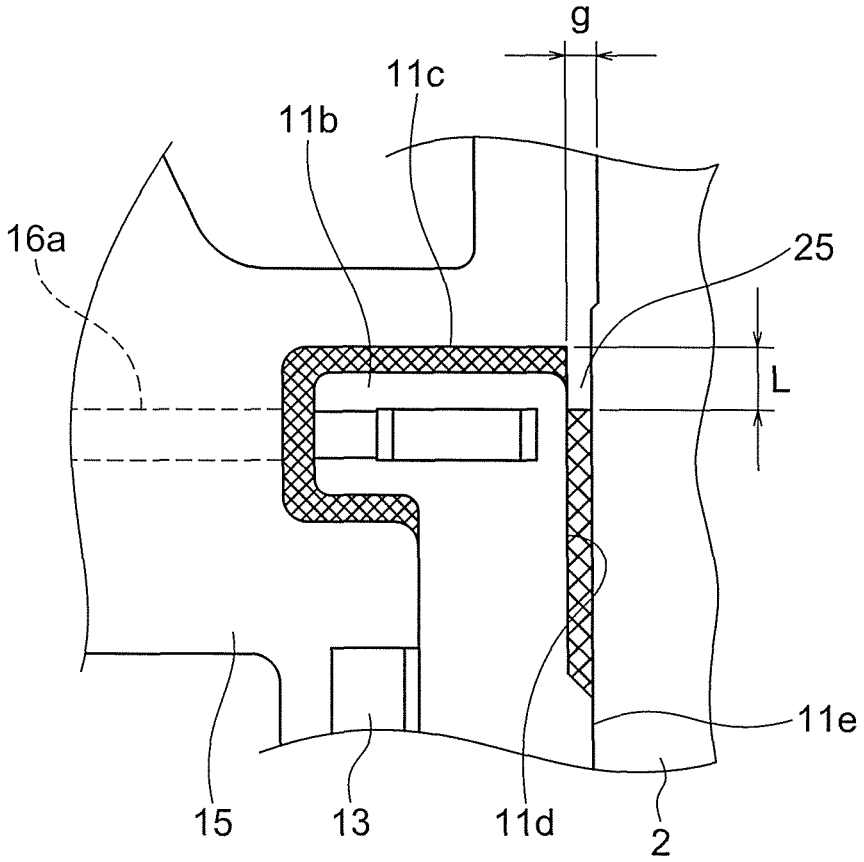
FIG. 2 is an enlarged sectional view showing the vicinity of an upper end portion of a bobbin shown in FIG. 1.
Figure 3:
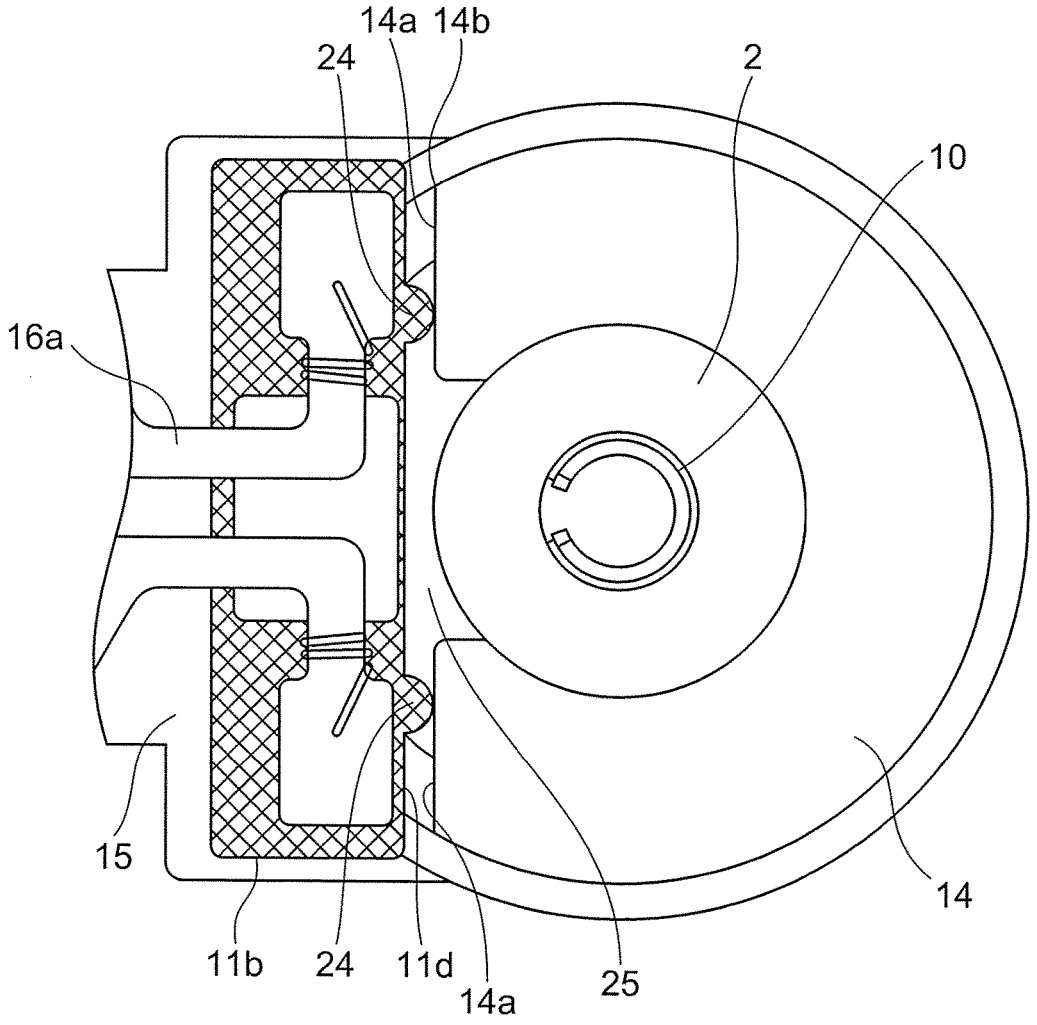
FIG. 3 is a sectional view taken along a III-III line in FIG. 1.

FIG. 2 is an enlarged sectional view showing the vicinity of the upper end portion of the bobbin 11 shown in FIG. 1, and FIG. 3 is a sectional view taken along a line in FIG. 1. The coil connection portions 16*a* are disposed parallel to a plane that is orthogonal to the axial direction of the fuel injection valve, or in other words disposed horizontally. Further, respective tip ends of the coil connection portions 16*a* are inserted into the terminal housing portion 11*b* and electrically connected to the coil 12.

A housing portion inner surface 11*d* serving as a core 2 side surface of the terminal housing portion 11*b* of the bobbin 11 is a vertical or substantially vertical surface. A pair of opposing surfaces 14*a* opposing the housing portion inner surface 11*d* are formed on the cutout portion of the cap 14. A pair of projecting portions (nibs) 24 formed in a semi-columnar shape (i.e. having a semicircular cross-section) are provided on the housing portion inner surface 11*d* to extend in the axial direction of the core 2 and project toward the opposing surface 14*a* side so as to contact the opposing surfaces 14*a*.

By bringing the projecting portions 24 into contact (line contact or surface contact) with the opposing surfaces 14*a*, outside corner portions 14*b* of the opposing surfaces 14*a* are prevented from approaching the bobbin 11, and the opposing surfaces 14*a* are caused to remain parallel or substantially parallel to the housing portion inner surface 11*d*. Respective upper end portions of the projecting portions are formed with spherical rounded edges so that the core 2 can be inserted smoothly into the bobbin 11.

A bobbin inner peripheral surface 11*e* serving as an inner peripheral surface of the bobbin main body 11*a* contacts an outer peripheral surface of the core 2. The housing portion inner surface 11*d* is offset outwardly in a radial direction of the bobbin 11 relative to the bobbin inner peripheral surface 11*e*. In other words, a radial direction step is provided between the housing portion inner surface 11*d* and the bobbin inner peripheral surface 11*e*.

Hence, a gap 25 is formed to extend in a radial direction of the core 2 from the housing portion inner surface 11*d* to the opposing surfaces 14*a* and the outer peripheral surface of the core 2. Resin used to form the connector mold 15 penetrates the gap 25.

The upper end portions of the projecting portions 24 are positioned below the housing portion upper surface 11*c* by a step L (FIG. 2). As a result, moisture is prevented from advancing from an upper surface of the cap 14 to the housing portion upper surface 11*c* via the upper end portions of the projecting portions 24.

When the fuel injection valve is installed in a motorcycle and water is splashed up by the motorcycle, for example, such that the fuel injection valve becomes wet, moisture may infiltrate the fuel injection valve through a boundary portion between the core 2 and the connector mold 15 from a lower portion of the rubber ring 17. The infiltrating moisture advances to the bobbin 11, and is then led to the gap 25 between the housing portion inner surface 11*d* and the core 2 and cap 14.

However, the connector mold 15 penetrates the gap 25 so as to form a barrier wall, and therefore the moisture is unlikely to reach the housing portion upper surface 11*c*. Further, the distance from the gap 25 to the housing portion upper surface 11*c* is great and an infiltration path includes many corner portions, and therefore the moisture is unlikely to reach the housing portion upper surface 11*c* likewise due to a barrier effect produced by the corner portions. Hence, a situation in which the coil connection portions 16*a* of the terminals 16 are connected to the core 2 or the cap 14 by the moisture such that these members become electrically conductive is prevented from occurring, and therefore a leak current is not generated. Accordingly, moisture is prevented from contacting the terminals 16 within the connector mold 15, and as a result, a stable injection amount characteristic can be realized. Moreover, an improvement in durability can be achieved.

Further, the fuel injection valve according to the first embodiment contacts the sealing member 22 on the joint end surface 15*b* such that an inner peripheral portion of the sealing member 22, a sealing surface of which extends in the axial direction, is set in a negative pressure condition below atmospheric pressure. Meanwhile, the boundary portion between the core 2 and the connector mold 15 below the rubber ring 17 is at a higher pressure than a boundary portion between the holder 1 and the connector mold 15 on the joint end surface 15*b*.

Hence, the moisture led into the gap 25 is drawn toward the sealing member 22 side so as to infiltrate between the bobbin 11 and the core 2, and is therefore unlikely to reach the housing portion upper surface 11*c* side. As a result, a situation in which the coil connection portions 16*a* are connected to the core 2 or the cap 14 by the moisture such that these members become electrically conductive is prevented from occurring even more reliably.

Furthermore, the gap 25 is formed by providing the radial direction step between the housing portion inner surface 11*d* and the bobbin inner peripheral surface 11*e*, and therefore the gap 25 can be formed simply by modifying the shape of the bobbin 11. As a result, a stable injection amount characteristic can be realized at low cost.

Moreover, the corner portions 14*b* of the cap 14 are prevented from approaching the bobbin 11 by forming the projecting portions 24 on the bobbin 11, and therefore moisture that reaches the upper surface of the cap 14 from the boundary portion between the core 2 and the connector mold 15 can be prevented from reaching the housing portion upper surface 11*c* from the corner portions 14*b*.

Furthermore, by bringing the projecting portions 24 into line contact with the opposing surfaces 14*a*, the respective parts can be incorporated smoothly by subjecting the tip end portions of the projecting portions 24 to elastoplastic deformation even in a case where the projecting portions 24 interfere with the cap 14 by a large amount due to dimensional variation in the respective parts.

Meanwhile, by bringing the projecting portions 24 into surface contact with the opposing surfaces 14*a*, the respective parts can be incorporated by displacing the entire terminal housing portion 11*b*, rather than subjecting the tip end portions of the projecting portions 24 to elastoplastic deformation, even in a case where the projecting portions 24 interfere with the cap 14 by a large amount due to dimensional variation in the respective parts. As a result, an interval between the housing portion inner surface 11*d* and the opposing surfaces 14*a* is substantially equal to the height of the projecting portions 24, and therefore the projecting portions 24 can be incorporated without reducing the size of the interval.

Moreover, the sealing member 22 is interposed between the valve mounting portion 21 and the joint end surface 15*b* by which the connector mold 15 is joined to the valve mounting portion 21, and therefore the boundary portion between the connector mold 15 and the holder 1 is close enough to the intake passage 21*a* to be set at a comparatively low pressure. As a result, moisture infiltrating through the gap 25 is attracted to the intake passage 21*a* side, and is therefore unlikely to reach the housing portion upper surface 11*c* of the bobbin 11.

Figure 4:
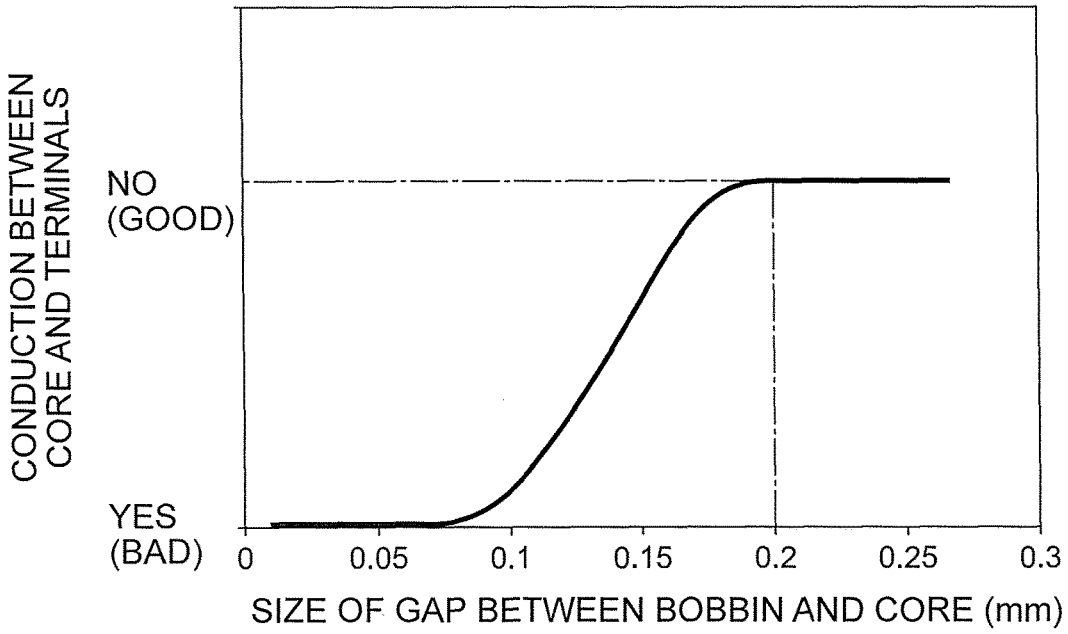
FIG. 4 is a graph showing results of an experiment in which the size of a gap between a housing portion inner surface of the bobbin and a core was varied and a conduction condition between the core and a terminal was checked.

Here, FIG. 4 a graph showing results of an experiment in which the size (abscissa) of an interval between the housing portion inner surface 11*d* of the bobbin 11 and the core 2, or in other words the gap 25, was varied and the conduction condition (ordinate) between the core 2 and the terminals 16 was checked. When a conduction resistance valve b relative to an interval a is expressed in terms of (a:b), experiment results of (0.01:0.1), (0.03:0.1), (0.04:0.1), (0.06:0.1), (0.07:0.1), (0.09:0.3), (0.1:1), (0.12:2.5), (0.13:4), (0.15:6), (0.16:8), (0.18:9.5), (0.19:10), (0.21:10), (0.22:10), (0.24:10), (0.25:10), and (0.27:10) were obtained.

It can be seen from these experiment results that the interval (a dimension g in FIG. 2) between the housing portion inner surface 11*d* and the core 2 is preferably no smaller than 0.2 mm. As a result, the resin of the connector mold 15 can flow into the gap 25 more reliably so that a more reliable barrier is formed between the housing portion inner surface 11*d* and the core 2.

Figure 5:
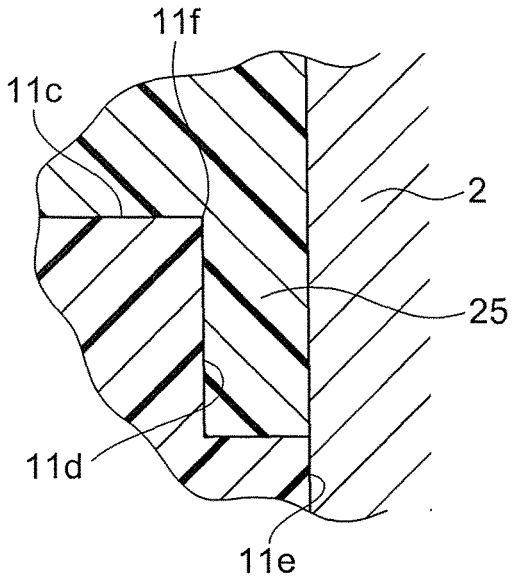
FIG. 5 is a schematic sectional view showing a gap shown in FIG. 2.
Figure 6:
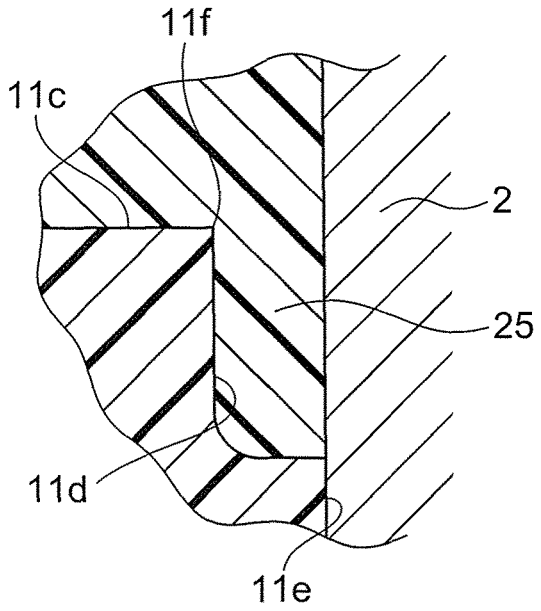
FIG. 6 is a sectional view showing a condition in which a shear drop is formed in a corner portion of the gap shown in FIG. 5.

Further, FIG. 5 is a schematic sectional view showing the gap 25 shown in FIG. 2. A dimension of the gap 25 in the axial direction of the core 2 is preferably at least twice as large as the interval between the core 2 and the housing portion inner surface 11*d*. According to this configuration, even when a rounded edge (R) or a shear drop having an identical radius to the step is formed on a bobbin 11 side corner portion of the gap 25, as shown in FIG. 6, for example, an edge portion 11*f* between the housing portion upper surface 11*c* and the housing portion inner surface 11*d* remains substantially right-angled, without being affected by the shear drop portion. Hence, the bobbin 11 exerts a wedge effect on the connector mold 15, thereby preventing moisture from traveling over the edge portion 11*f* and moving onto the housing portion upper surface 11*c*.

Figure 7:
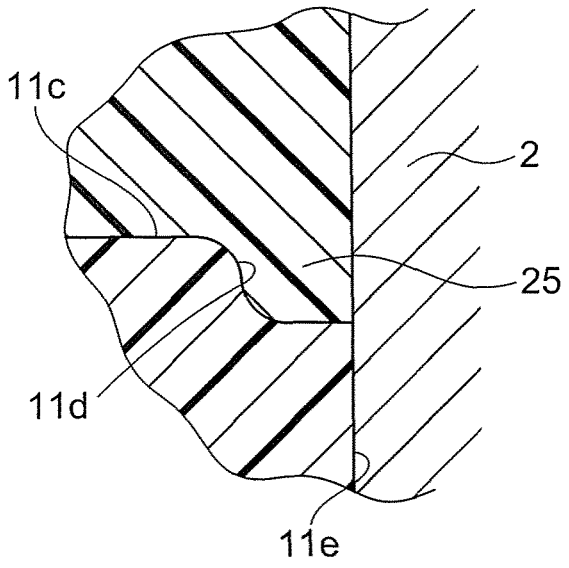
FIG. 7 is a sectional view showing a case in which an axial direction dimension of the gap shown in FIG. 6 is small.

When, on the other hand, the dimension of the gap 25 in the axial direction of the core 2 is small, as shown in FIG. 7, for example, the length of a path extending to the housing portion upper surface 11*c* shortens and the edge portion 11*f* becomes rounded in accordance with the shear drop portion, making it easier for moisture to move onto the housing portion upper surface 11*c*.

Second Embodiment

Figure 8:
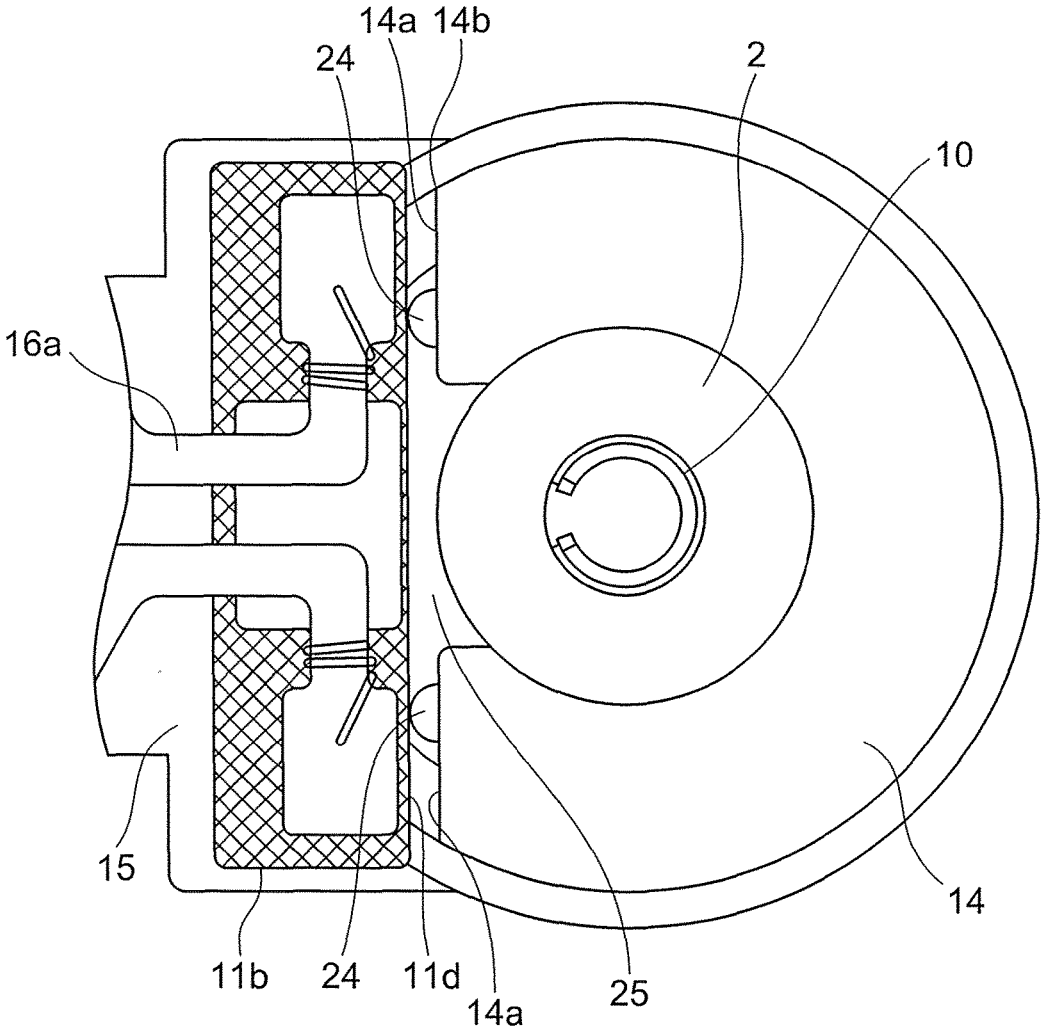
FIG. 8 is an enlarged sectional view showing main parts of a fuel injection valve according to a second embodiment of this invention.

FIG. 8 is an enlarged sectional view showing main parts of a fuel injection valve according to a second embodiment of this invention. In the first embodiment, the projecting portions 24 are formed on the housing portion inner surface 11*d*, whereas in the second embodiment, the projecting portions 24 are formed on the opposing surfaces 14*a* of the cap 14. The projecting portions 24 project toward the housing portion inner surface 11*d* side so as to contact the housing portion inner surface 11*d*. All other configurations are similar or identical to the first embodiment.

According to this configuration, the projecting portions 24 are formed on the metal cap 14, and therefore dimensional variation in the projecting portions 24 due to water absorption, creep, and other properties unique to resin does not occur. As a result, variation in the size of the gap 25 can be suppressed.

Further, by bringing the projecting portions 24 into line contact with the housing portion inner surface 11*d*, the respective parts can be incorporated smoothly by subjecting the housing portion inner surface 11*d* to elastoplastic deformation even in a case where the projecting portions 24 interfere with the housing portion inner surface 11*d* by a large amount due to dimensional variation in the respective parts. Moreover, in contrast to the first embodiment, the resin bobbin 11 forms a depressed side, thereby reducing the danger of the respective parts falling out due to plastic deformation and ensuring that the respective parts can be incorporated in an uncontaminated condition.

Meanwhile, by bringing the projecting portions 24 into surface contact with the housing portion inner surface 11*d*, formation of a depression in the housing portion inner surface 11*d* can be suppressed, in contrast to the first embodiment, thereby preventing the projecting portions 24 from approaching or contacting the terminals 16. As a result, a fuel injection valve that does not suffer from short-circuit faults can be manufactured.

Note that the sectional shape of the projecting portion 24 is not limited to a semicircular shape, and a triangular shape, a trapezoidal shape, or the like, for example, may be employed instead.

The invention claimed is:

1. A fuel injection valve comprising:

a holder;

a valve seat fixed to the holder;

a valve body to slide in the holder;

a spring to push the valve body toward a side of the valve seat side;

a solenoid device that includes a metal core fixed to the holder, a resin bobbin mounted on an outer periphery of the core, a coil wound around the bobbin, a metal housing surrounding the bobbin, and a metal cap provided on an end portion of the metal housing to cover the bobbin, wherein the solenoid device is to generate an electromagnetic force for pulling the valve body away from the valve seat against the spring;

a connector mold that includes a connector portion and is molded integrally with the holder and the solenoid device; and a terminal that is drawn out from the connector portion and electrically connected to the coil, wherein the bobbin includes a bobbin main body serving as a part around which the coil is wound, and a terminal housing portion projecting upward from a part of a circumferential direction of the bobbin main body, the terminal housing portion is exposed to the exterior of the metal cap, the terminal is inserted into the terminal housing portion and electrically connected to the coil, a gap is provided between the core and a housing portion inner surface serving as a core side surface of the terminal housing portion, resin that forms the connector mold penetrates the gap, a projecting portion is formed on the housing portion inner surface so as to project toward an opposing surface of the metal cap, the opposing surface being a surface that opposes the housing portion inner surface, and the projecting portion contacts the opposing surface so that the gap is provided to extend from the housing portion inner surface to the core and the metal cap.

2. The fuel injection valve according to claim 1, wherein a step extending in a radial direction is provided between an inner peripheral surface of a main body of the coil and the housing portion inner surface, whereby the gap is provided between the housing portion inner surface and the core.

3. The fuel injection valve according to claim 2, wherein a dimension of the gap in an axial direction of the core is at least twice as large as an interval between the core and the housing portion inner surface.

4. The fuel injection valve according to claim 1, wherein an interval between the housing portion inner surface and the core is no smaller than 0.2 mm.

5. The fuel injection valve according to claim 1, wherein the projecting portion contacts the opposing surface by line contact.

6. The fuel injection valve according to claim 1, wherein the projecting portion contacts the opposing surface by surface contact.

7. The fuel injection valve according to claim 1, further comprising a sealing member that is interposed between a valve mounting portion of an internal combustion engine and a joint end surface of the connector mold, the joint end surface being a surface by which the connector mold is joined to the valve mounting portion.

8. A fuel injection valve comprising:

a holder;

a valve set fixed to the holder;

a valve body to slide in the holder;

a spring to push the valve body toward a side of the valve seat;

a solenoid device that includes a metal core fixed to the holder a resin bobbin mounted on an outer periphery of the core, a coil wound around the bobbin, a metal housing surrounding the bobbin, and a metal cap provided on an end portion of the metal housing to cover the bobbin, wherein the solenoid device is to generate an electromagnetic force for pulling the valve body away from the valve seat against the spring;

a connector mold that includes a connector portion and is molded integrally with the holder and the solenoid device; and a terminal that is drawn out from the connector portion and electrically connected to the coil, wherein the bobbin includes a bobbin main body serving as a part around which the coil is wound, and a terminal housing portion projecting upward from a part of a circumferential direction of the bobbin main body, the terminal housing portion is exposed to the exterior of the metal cap, the terminal is inserted into the terminal housing portion and electrically connected to the coil, a gap is provided between the core and a housing portion inner surface serving as a core side surface of the terminal housing portion, resin that forms the connector mold penetrates the gap, a projecting portion that projects toward the housing portion inner surface is formed on an opposing surface of the metal cap, the opposing surface being a surface that opposes the housing portion inner surface, and the projecting portion contacts the housing portion inner surface so that the gap is provided to extend from the housing portion inner surface to the core and the metal cap.

9. The fuel injection valve according to claim 8, wherein the projecting portion contacts the housing portion inner surface by line contact.

10. The fuel injection valve according to claim 8, wherein the projecting portion contacts the housing portion inner surface by surface contact.

11. The fuel injection valve according to claim 8, further comprising a sealing member that is interposed between a valve mounting portion of an internal combustion engine and a joint end surface of the connector mold, the joint end surface being a surface by which the connector mold is joined to the valve mounting portion.

* * * * *